United States Patent [19]

Semanko

[11] Patent Number: 4,510,653

[45] Date of Patent: Apr. 16, 1985

[54] METHOD AND APPARATUS FOR TYING BALLOONS AND THE LIKE

[76] Inventor: Mark Semanko, 47 West Levering Mill Rd., Bala Cynwyd, Pa. 19004

[21] Appl. No.: 431,265

[22] Filed: Sep. 30, 1982

[51] Int. Cl.[3] ..... A44B 21/00; A63H 3/06

[52] U.S. Cl. ..... 24/131 C; 24/289; 24/511; 446/222

[58] Field of Search ..... 24/137 R, 137 A, 139.1, 24/131 C, 132 WL, 255 R, 253, 343, 8, 10; 46/88, 90; 411/508

[56] References Cited

U.S. PATENT DOCUMENTS

| | | | |
|---|---|---|---|
| 121,303 | 11/1871 | Wattles | 24/137 A |
| 195,159 | 9/1877 | Peoples | 24/252 R |
| 544,392 | 8/1895 | Smith | 24/343 |
| 763,793 | 6/1904 | Pickert | 24/137 R |
| 1,407,474 | 2/1922 | Nielsen | 24/343 |
| 2,396,906 | 3/1946 | Windson | 46/90 |
| 2,514,698 | 7/1950 | Herrero | 24/137 A |
| 2,532,674 | 12/1950 | Nelsen | 24/137 R |
| 2,882,645 | 4/1959 | Stivers | 46/90 |
| 2,931,133 | 4/1960 | Dodson | 46/90 |
| 3,262,414 | 7/1966 | Monk | 24/137 R |
| 3,267,604 | 8/1966 | Goldsmith | 46/88 |
| 3,453,700 | 7/1969 | Petertil et al. | 24/137 R |
| 3,780,419 | 12/1973 | Allison et al. | 46/90 |
| 3,783,551 | 1/1974 | Allison et al. | 46/90 |
| 3,908,235 | 9/1975 | Telliard et al. | 411/508 |
| 3,911,974 | 10/1975 | Kuykendall | 46/90 |
| 3,914,007 | 10/1975 | Seidler | 24/137 R |
| 4,020,530 | 5/1977 | Sartore | 24/252 R |

*Primary Examiner*—Victor N. Sakran

*Attorney, Agent, or Firm*—Steele, Gould & Fried

[57] ABSTRACT

A method for tying balloons and the like, having apertured ends and necks, comprising the steps of: looping the neck of the balloon around a pair of movable jaws resiliently urged toward one another and defining a channel therebetween perpendicular to their plane of movement; moving the end of the balloon over the loop and through the jaws, so as to extend through the channel; and, rolling the loop over the end of the balloon, continuing toward and off the ends of the jaws, whereby the loop resiliently snaps into place, forming a knot in the neck of the balloon. The method may further comprise the step of feeding a string through one of the pair of movable jaws so as to extend through the loop prior to rolling the loop over the end of the jaws, whereby a plurality of balloons can be sequentially and automatically tied on the string.

An apparatus for tying balloons and the like, comprising: a pair of movable jaws resiliently urged toward one another, defining a channel perpendicular to their plane of movement; and, a longitudinal bore through one of the jaws perpendicular to, but not intersecting the channel.

5 Claims, 14 Drawing Figures

METHOD AND APPARATUS FOR TYING BALLOONS AND THE LIKE

BACKGROUND OF THE INVENTION

1. Field of the Invention

This invention relates to the field of tying or knotting balloons in general, and in particular, to a manually operable mechanical device which facilitates tying balloons, and which enables a plurality of balloons to be sequentially and automatically tied on a string, as well as to a method for practicing the invention.

2. Description of the Prior Art

As is known to all those who have had to inflate and tie a large number of balloons for a birthday party, political rally or other such gathering, the resilient nature of the material from which the balloons are constructed is such that one's fingertips are constantly pinched and strained. In many instances, adults find that their fingers are too large to manipulate the necks of smaller balloons.

In order to alleviate this problem, those skilled in the art have developed a number of mechanical aids or devices about which the neck of a balloon can be twisted and turned after inflation, avoiding the need to actually tie a knot in the neck of the balloon. These devices rely upon resiliently pulling the necks of the balloons over abrupt edges in order to frictionally seal them. Examples of such devices are disclosed in U.S. Pat. Nos. 1,680,318—Callahan, 2,396,906—Windson, 2,882-645—Stivers, 2,931,133—Datsun, 3,267,604—Goldsmith, 3,780,419—Allison, et al and 3,783,551—Allison, et al. A balloon dispensing and filling machine is disclosed in U.S. Pat. No. 3,911,974—Kuykendall.

This invention solves the problem of how to easily tie balloons and the like, by providing a method and apparatus which assists in actually tying a knot in the neck of the balloon with balloon material. This provides a superior seal, which cannot be easily twisted or undone. Moreover, as the same instrument can be utilized for tying as many balloons as is necessary, the cost of such a device is negligible as compared to providing specially machined or molded disks or other parts, one of which must be provided for each and every balloon.

Another problem facing those skilled in the art is the time needed to tie a number of balloons together, for instance on a single string. It is now necessary to tie the balloons separately, and then tie each one to the string, or to use a knot in the string to hold and seal each balloon. The latter method does not provide secure sealing, and in both instances, much time can be wasted. Some of the above cited references, for example U.S. Pat. No. 3,783,551—Allison et al, show that a string can be attached, but only by use of the same disk used to seal the balloon. This invention provides a means for automatically tying balloons to a continuous string, without having to make any additional knots or ties.

With reference the presently preferred embodiment shown in FIGS. 1–13, those skilled in the art will not fail to appreciate that the apparatus 10 is not unlike a spring-loaded clothespin. It must be remembered, however, that those skilled in the art of manufacturing clothespins would never have any reason to suspect that it would be advantageous to use a clothespin in its basic form to the balloon or supply a longitudinal bore 34 such as that disclosed in FIG. 1, which would enable balloons to be knotted and automatically tied onto a string. Moreover, those skilled in the art of inflating and tying balloons would have no reason to suspect that a clothespin could be used in its basic form for the purpose of tying balloons, or in a revised form, for tying balloons onto a string.

SUMMARY OF THE INVENTION

It is an object of this invention to provide an improved method for knotting balloons and the like.

It is another object of this invention to provide an apparatus which enables one to easily tie or knot balloons and the like.

It is still another object of this invention to provide a method and apparatus which enables a plurality of balloons to be easily and sequentially knotted, and at the same time, "automatically" attached to a string.

These and other objects of this invention are accomplished by a method comprising the steps of: looping the neck of the balloon around a pair of movable jaws resiliently urged toward one another and defining a channel therebetween perpendicular to their plane of movement; moving the end of the balloon over the loop and through the jaws, so as to extend through the channel; and, rolling the loop over the end of the balloon, continuing toward and off the ends of the jaws, whereby the loop resiliently snaps into place, forming a knot in the neck of the balloon. The method may further comprise the step of feeding a string through one of the pair of movable jaws so as to extend through the loop prior to rolling the loop over the end of the jaws, whereby a plurality of balloons can be sequentially and automatically tied on the string.

These and other objects are also accomplished by an apparatus for tying balloons and the like, comprising: a pair of movable jaws resiliently urged toward one another, defining a channel perpendicular to their plane of movement; and, a longitudinal bore through one of the jaws perpendicular to, but not intersecting the channel.

BRIEF DESCRIPTION OF THE DRAWINGS

This invention will be described in connection with the following drawings, it being understood, however, that this invention is not limited to the precise arrangements and instrumentalities shown.

FIGS. 1–13 sequentially illustrate how a balloon may be knotted in accordance with the steps of the method taught herein.

DETAILED DESCRIPTION OF THE PREFERRED EMBODIMENTS

Figure 1:
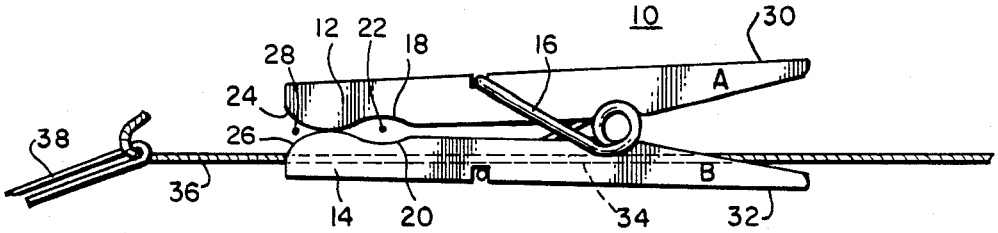
FIGS. 1–5 are each a top plan view of an apparatus according to this invention.

An apparatus according to this invention is shown in FIGS. 1–13, and generally designated 10. The apparatus 10 comprises a pair of jaws 12 and 14, at least one of which is movable relative to the other, and which are resiliently urged toward one another by a spring member 16. The jaws 12 and 14 comprise arcuate portions 18 and 20 which define a channel 22 perpendicular to the plane of movement of the jaws 12 and 14. The jaws 12 and 14 further comprise arcuate portions 24 and 26 which define a guideway 28 into the channel 22.

Jaws 12 and 14 further comprise handle sections 30 and 32 respectively extending therefrom, which can be pressed toward one another in order to open guideway 28 and permit entry into channel 22. In order to distinguish the sides or edges of the apparatus 10 which are visable in what is defined as the top plan view, they have been designated as A and B. The edges or surfaces visable in the bottom plan view (FIGS. 6–8 and 12) are designated C and D. The jaw/handle members may be formed from wood, plastic or other suitable material.

One of the jaw/handle members (12, 30 or 14, 32) is provided with a longitudinal bore 34 through which a string or the like 36 can be pulled, for example by means of a very thin wire 38 having a hook at one end. With regard to the method for tying or knotting a plurality of balloons onto a string, insertion of the string 36 in the bore 34 is in fact the first step. The term string is intended to include all materials of similar characteristics, such as cord, twine, monofilament and others.

Figure 2:
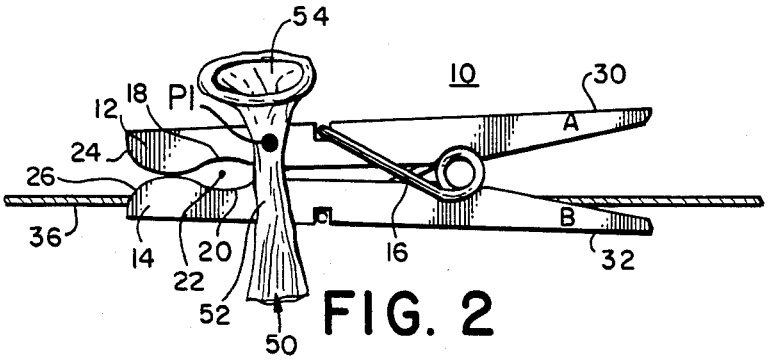

A balloon 50 is partially shown in FIG. 2. The balloon 50 comprises a neck portion 52 and an apertured end 54. As balloons and the like are usually made from resilient and stretchable material, and as balloons and the like come in a wide variety of sizes and shapes, the precise length of the neck of a balloon is difficult to determine. For purposes of this invention, and for purposes of this explanation, the neck 52 will be considered to be that portion of the balloon which is not substantially inflated or is not inflated at all. It will also be assumed for purposes of this explanation that the neck 52 of the balloon 50 will be of sufficient length (whether due to inherent length or elasticity) to be manipulated in the fashion described herein. It is the inflated portion of the balloon 50 which is not shown in the drawings.

The second step in the method is illustrated in FIG. 2, wherein the neck 52 of the balloon 50 is placed against the top of the apparatus 10 such that the apertured end 54 extends somewhat beyond jaw-handle member 12, 30. The black dot on the neck 52, designated by P1, represents a pressure point at which the neck of the balloon is manually pressed against the jaw-handle member 12, 30. For a person holding the apparatus 10 in his or her right hand, appropriate pressure can be conveniently applied by the thumb, with the fingers curled around handles 30 and 32.

Figure 3:
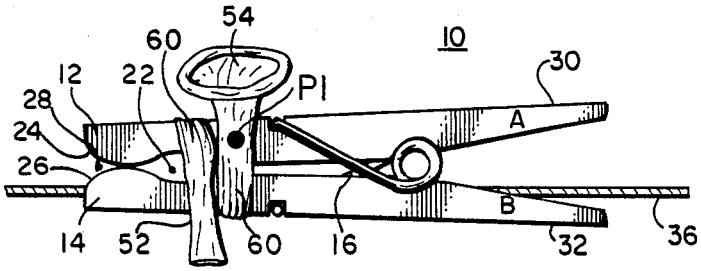

The third step is illustrated in FIG. 3. Maintaining the pressure point P1, the neck 52 of the balloon 50 is wound around both jaws 12 and 14, forming a loop 60 which is disposed to the right of channel 22. With respect to a left side elevation of FIG. 3, the inflated portion of the balloon is passed once around the apparatus 10, in a clockwise direction.

Figure 4:
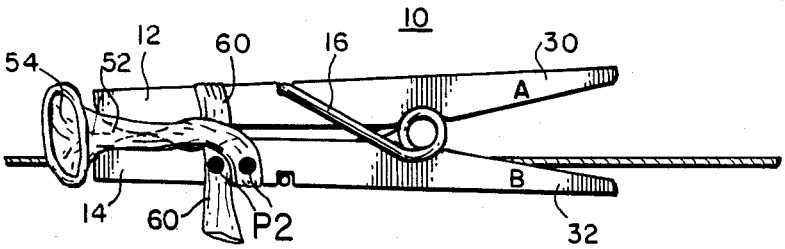

The fourth step is shown in FIG. 4. After the loop 60 has been formed, pressure is applied at pressure points P2 instead of P1. The apertured end 54 of the balloon is moved perpendicularly over the loop 60 so as to extend somewhat beyond the ends of the jaws 12 and 14, (to the left with respect to the orientation of FIG. 4).

Figure 5:
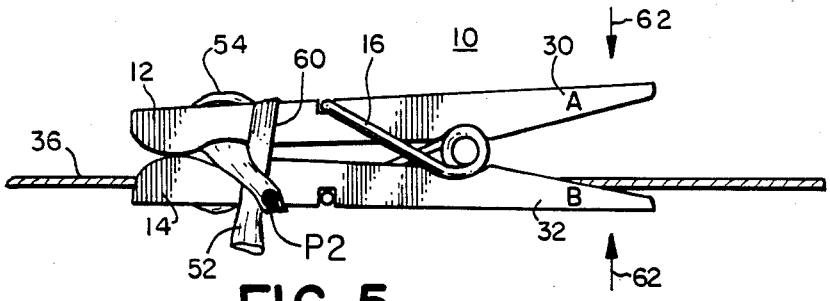
Figure 6:
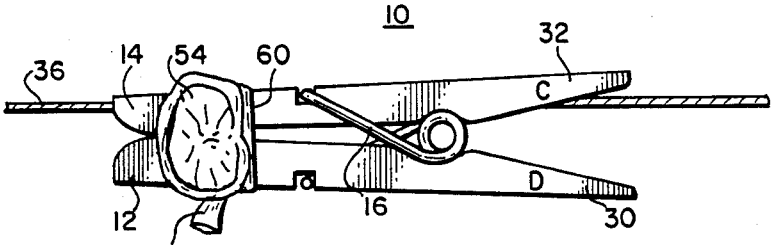
FIGS. 6–8 are each a bottom plan view of the apparatus.

The fifth step is shown in FIG. 5. Maintaining pressure at point P2, the handles 30 and 32 are urged slightly toward one another as indicated by arrows 62. This opens jaws 12 and 14 sufficiently to enable the endmost portion of the neck 52 to pass through the guideway 28 and into the channel 22. The apertured end 54 now extends out of the channel 52, on the opposite side of the apparatus 10. This is illustrated more fully in FIG. 6, which is a bottom plan view. In FIG. 6 the apertured end 54 extends out of the channel 22, and loop 60 is disposed to the right thereof.

Figure 7:
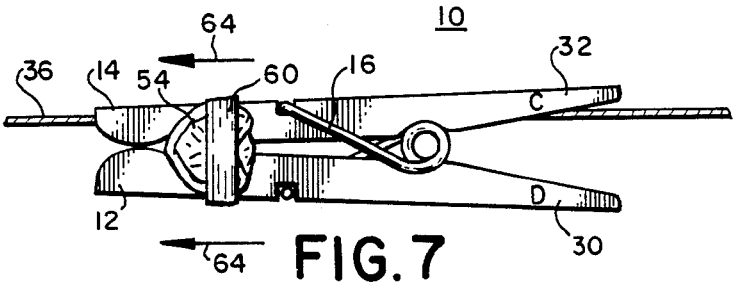

The next step is shown in FIG. 7, wherein loop 60 is rolled, pushed and/or urged in the direction of arrows 64 toward the ends of the jaws 12 and 14 and over apertured end 54. The completion of the rolling step is shown in FIG. 8, wherein the loop 60 is now to the left of the apertured end 54 having passed completely thereover.

Figure 8:
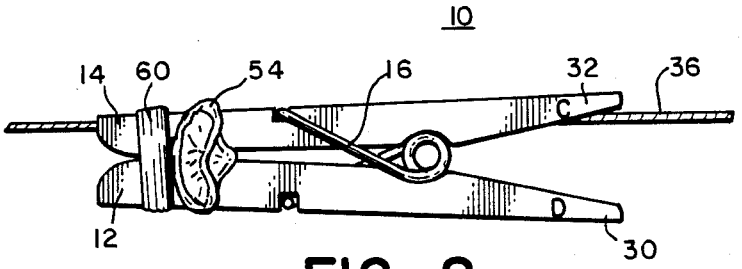
Figure 9:
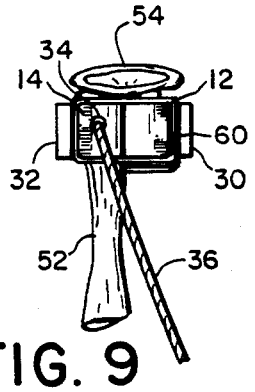
FIGS. 9–11 are each a left side elevation of the apparatus.

FIG. 9 is a left side elevation showing the relative positions of the neck of the balloon and the apparatus 10 as in FIG. 8. It can be appreciated from FIG. 9 that the string 36 is disposed so as to be passing through loop 60 as it emerges from bore 34.

Figure 10:
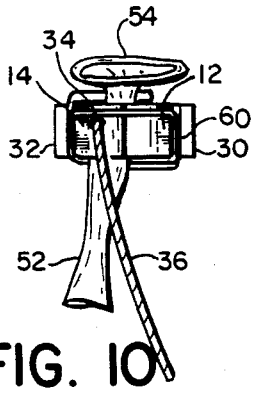
Figure 11:
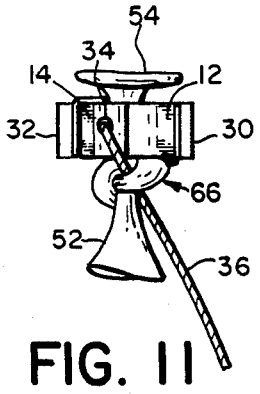
Figure 12:
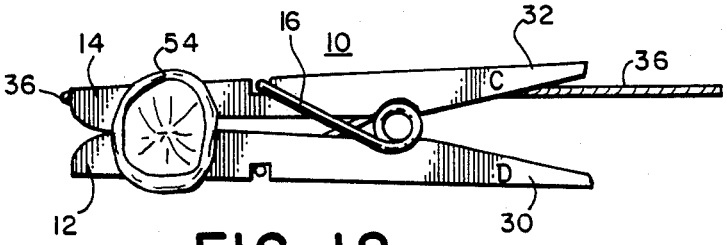
FIG. 12 is a bottom plan view of the apparatus.
Figure 13:
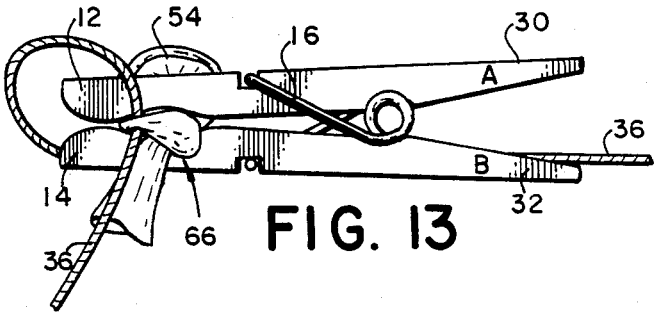
FIG. 13 is a top plan view of the apparatus.

The next steps are illustrated in FIGS. 10–12. As the loop 60 is rolled further to the left, with respect to FIG. 8, it eventually pops or snaps off the ends of the jaws 12 and 14, "automatically" forming a knot 66 as shown in FIG. 11. As is also shown in FIG. 11, the string 36 has been "automatically" caught in the knot 66, firmly securing the balloon to the string without interfering with the sealing of the balloon provided by knot 66 and without having tied a knot in the string.

In the bottom plan view of FIG. 12, the apertured end 54 still extends above the channel 22. In the top plan view of FIG. 13, the knot 66 and captured string 36 are shown once again. At this point, handles 30 and 32 can be urged toward one another, to open jaws 12 and 14, and release the knotted balloon.

It will be appreciated by those skilled in the art that balloons can be tied in accordance with this invention without using the string 36, where it is not required to have the balloon so tied.

Figure 14:
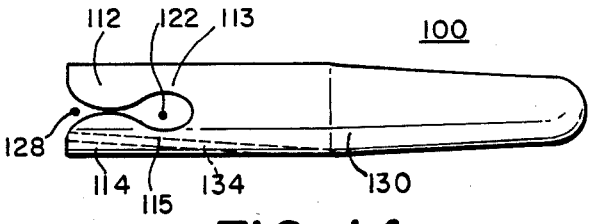
FIG. 14 is a top plan view of an alternative embodiment of an apparatus according to this invention.

An alternative embodiment of the invention is shown in FIG. 14 and generally designated 100. The apparatus 100 is an integrally formed or molded member, of a resilient plastic material or the like. Jaws 112 and 114 are integrally formed with a handle 130 and shaped so as to define a channel 122 and a guideway 128. Narrow portions 113 and 115 enable jaws 112 and 114 to be resiliently urged toward one another, if separated in accordance with the method taught herein, for example step 5. Bore 134 need not extend fully through the handle, either in this embodiment or in apparatus 10. It should, however, extend at least somewhat past channel 122 (or 22), that is, to the right thereof in the drawings.

It will be also appreciated that the invention can be embodied in other specific forms without departing from the spirit or essential attributes thereof, and accordingly, reference should be made to the appended claims, rather than to the specification, as indicating the scope of the invention.

I claim:

1. An apparatus for tying a knot in a neck of a balloon, the knot being wrapped around a string, comprising:

a clothspin having two members resiliently pivotally attached to one another intermediate to the ends of said members, the jaws when closed forming a channel aligned perpendicular to an axis defined by the members for receiving the neck of the balloon to be tied, one of the members having a longitudinal bore adapted to slidably receive the string, the bore being aligned parallel to said axis and opening adjacent the channel at an end of said one of the members, whereby the neck of the balloon is tied in a knot around and through the channel, and the knot slid easily from the apparatus onto the string.

2. An apparatus of claim 1, wherein the members are attached to one another by a spring having a coil, ends of the spring extending outwards from coil and being bent at right angles to engage outer surfaces of said members, the spring resiliently biasing the members closed around the channel.

3. The apparatus of claim 1, wherein the members are formed integrally, the members being connected by a portion of resilient material, the resilient material urging the members closed around the channel.

4. The apparatus of claim 1, wherein the clothspin is wooden.

5. The apparatus of claim 1, wherein the clothspin is plastic.

* * * * *